US005095804A

United States Patent [19]

Burch

[11] Patent Number: 5,095,804

[45] Date of Patent: Mar. 17, 1992

[54] DRIVE FOR A STEAM SERVO VALVE

[75] Inventor: Edi Burch, Würenlos, Switzerland

[73] Assignee: Asea Brown Boveri Ltd., Baden, Switzerland

[21] Appl. No.: 674,888

[22] Filed: Mar. 26, 1991

[30] Foreign Application Priority Data

Apr. 9, 1990 [CH] Switzerland ..... 1204/90

[51] Int. Cl.[5] ..... F15B 13/00; F15B 11/00

[52] U.S. Cl. ..... 91/361; 91/365; 91/403; 91/454; 91/461

[58] Field of Search ..... 91/361, 362, 363 R, 91/365, 403, 404, 459, 388, 449, 450, 463, 454, 461

[56] References Cited

U.S. PATENT DOCUMENTS

| | | | |
|---|---|---|---|
| 3,620,129 | 11/1971 | Fruehauf | 91/461 |
| 4,165,613 | 8/1979 | Bernhoft et al. | 91/461 |
| 4,275,691 | 6/1981 | Wolff et al. | 91/363 R |
| 4,276,810 | 7/1981 | Zeuner et al. | 91/449 |
| 4,401,009 | 8/1983 | Zeuner et al. | 91/28 |
| 4,531,449 | 7/1985 | Reith | 91/461 |
| 4,727,791 | 3/1988 | Satoh | 91/363 R |
| 4,741,247 | 5/1988 | Glomeau et al. | 91/459 |
| 4,870,892 | 10/1989 | Thomsen et al. | 91/459 |

FOREIGN PATENT DOCUMENTS

| | | | |
|---|---|---|---|
| 0127027 | 12/1984 | European Pat. Off. . | |
| 2411525 | 10/1974 | Fed. Rep. of Germany . | |
| 2113310 | 8/1983 | United Kingdom | 91/459 |

*Primary Examiner*—Edward K. Look
*Assistant Examiner*—Hoang Nguyen
*Attorney, Agent, or Firm*—Oblon, Spivak, McClelland, Maier & Neustadt

[57] ABSTRACT

A drive for a steam servo valve (2), including a control valve arrangement for regulating the actuating pressure of a servo drive (1), whereby the drive can always be actuated reliably and quickly even with comparatively high oil pressure. This is achieved by the control valve arrangement having at least two regulatable control valves (17, 21) which are pressure-actuated via at least one pilot regulating valve (proportional pressure valve 29, 34).

8 Claims, 3 Drawing Sheets

DRIVE FOR A STEAM SERVO VALVE

BACKGROUND OF THE INVENTION

1. Field of the Invention

The present invention starts from a drive for a steam servo valve.

2. Discussion of Background

Offenlegungsschrift DE 3,535,174 discloses a drive for a steam servo valve having a control valve arrangement which regulates the pressure of the oil for the hydraulic actuation of a servo drive. This control valve arrangement has a slide valve having sealing edges. Slide valves are only suitable to a limited extent for oil pressures above about 40 bar, since oil gumming and particle contamination can impair their function.

SUMMARY OF THE INVENTION

Accordingly, one object of the present invention is to provide a drive for a steam servo valve, which drive can always be actuated reliably and quickly even with comparatively high oil pressure.

The advantages achieved by the invention can essentially above object and the be seen in the fact that the better dynamics of the drive which can be achieved with higher oil pressures can now be fully utilized. Gumming of the control valve arrangement and an impairment associated therewith in the operational reliability of the servo drive can be eliminated with great certainty. In addition, it proves to be advantageous that valves of comparatively simple construction can be used, which increases the economy of the drive.

The invention, its further development and the advantages achievable therewith are described in greater detail below with reference to the drawing, which merely shows one method of embodiment.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
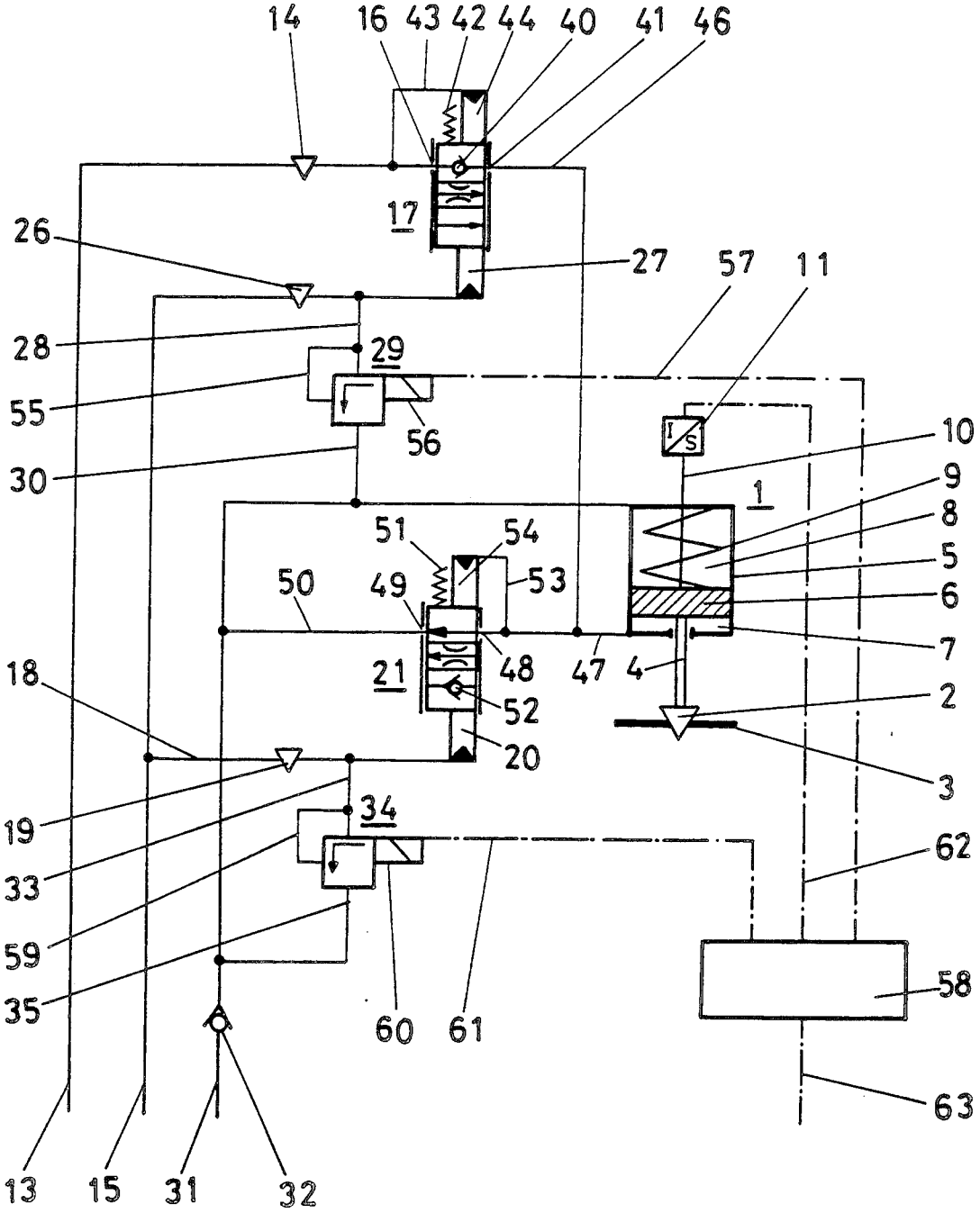
FIG. 1 shows a first embodiment of the drive.

Referring now to the drawings, wherein like reference numerals designate identical or corresponding parts throughout the several views, in FIG. 1 a servo drive 1 for a steam servo valve 2 is shown in a schematic representation, which steam servo valve 2 regulates the superheated steam quantity flowing through a superheated steam line 3 to a turbine (not shown). The steam servo valve 2 is connected by a valve spindle 4 to a main piston 6 sliding in a main cylinder 5. A drive volume 7 acted upon by oil under pressure is arranged below the main piston 6. Instead of the oil, another fluid or a gaseous medium can also be provided. In particular, the use of water or water emulsions is also possible. Provided above the main piston 6 is an oil-filled buffer volume 8 in which a spring 9 is also arranged which acts against the oil pressure in the drive volume 7. Provided on the spring side of the main piston 6 is a rod 10 which connects the same to a displacement-measuring device 11.

The rod 10 and the valve spindle 4 penetrate through the main cylinder 5 at opposite sides, and it is assumed that the instructions for these penetrations, carried out in a pressure-tight manner, are known.

Oil under pressure is fed in through a line 13; the oil pressure required is produced by a pump (not shown). The line 13 leads through a diaphragm 14, provided for limiting the opening time of the servo drive 1, to an inlet 16 of a first control valve 17 designed as a regulating valve. Oil under pressure is fed in from a safety-oil circuit through a line 15. Branching off from the line 15 is a line 18 which has a diaphragm 19 and which leads into a drive volume 20 of a second control valve 21 designed as a regulating valve. In addition, the line 15 has a diaphragm 26 and leads into a drive volume 27 of the first control valve 17. Branching off from the line 15 between the diaphragm 26 and the drive volume 27 is a line 28 which leads into a first proportional pressure valve 29 designed as a seat valve. An outlet 30 of this proportional pressure valve 29 is connected to a line 31 which is connected on the one side to the buffer volume 8 and on the other side to a drain means (not shown) via a check valve 32. The check valve 32 prevents oil-pressure surges, which may possibly pass into the drain means, from being able to react in a troublesome manner on the servo drive 1 through the line 31. From this drain means the oil passes further through the pump mentioned back into the line 13. Branching off from the line 18 between the diaphragm 19 and the drive volume 20 is a line 33 which leads into a second proportional pressure valve 34 designed as a seat valve. An outlet 35 of this proportional pressure valve 34 is connected to the line 31.

The first control valve 17 is shown in the closed state in FIG. 1, and in fact a seat valve 40 prevents the inlet 16 from being connected through to an outlet 41. The inlet 16 is connected to a drive volume 44 via a line 43. A pressure building up in this drive volume 44 acts in the same direction as the force of a spring 42, that is, against the pressure prevailing in the drive volume 27. As a rule, however, the piston area belonging to the drive volume 44 is smaller than that of the piston belonging to the drive volume 27 so as to ensure that the control valve 17 can always be actuated solely by the pressure of the safety oil. The first control valve 17 has three schematically shown operating positions, of which the uppermost, the blocking position, has already been described; the center position is a passage position having a regulatable cross-section and the lowermost position is a passage position having a constant cross-section. The control valve 17 is actuated by oil pressure in the drive volume 27, i.e., as oil pressure increases, it is pressed from the blocking position via the passage position having a regulatable cross-section into the passage position having a constant cross-section. The pressure in the drive volume 44 and the force of the spring 42 act against this oil pressure in the drive volume 27. The outlet 41 is connected via a line 46 to a connection 47 which connects with the drive volume 7 of the servo drive 1. In addition, this connection 47 is connected to an inlet 48 of the second control valve 21.

In the passage position shown, the inlet 48 of the second control valve 21 is connected through to an outlet 49.

The outlet 49 is connected via a line 50 to the line 31. The second control valve 21 has three schematically shown operating positions, of which the uppermost acts as a passage position having a constant cross-section. The center operating position acts as a passage position having a regulatable cross-section, and the lowermost operating position acts as a blocking position. The control valve 21 is actuated by oil pressure in the drive volume 20, i.e., as oil pressure increases, it is pressed from the passage position having a constant cross-section, via the passage position having a regulatable cross-section, into the blocking position. The force of a spring 51 acts against this oil pressure in the drive volume 20. The blocking position is realized by a seat valve 52. In addition, the inlet 48 is connected via a line 53 to a drive volume 54. A pressure building up in this drive volume 54 acts in the same direction as the force of the spring 51, that is, against the pressure prevailing in the drive volume 20. As a rule, however, the piston area belonging to the drive volume 54 is smaller than that of the piston belonging to the drive volume 20 so as to ensure that the control valve 21 can always be actuated solely by the pressure of the safety oil.

As already described, the two control valves 17 and 21 each have a passage position having a regulatable cross-section with in each case a certain regulating characteristic. This regulating characteristic can be designed to be the same in both control valves 17, 21, in which case the cross-sections to be regulated can be designed to be different. However, it is also possible for this regulating characteristic to be designed to be different in each of the two control valves 17, 21. Through these different regulating characteristics it is possible to optimally adapt the control valves 17, 21 to one another and to the respective operating requirements, so that the drive can be used in a comparatively wide range of applications. Any necessary adaptations to extended operating requirements can be carried out comparatively simply, since only the geometry in the region of the regulatable cross-section has to be changed.

The first proportional pressure valve 29 acts like a regulatable diaphragm in which on one side the diaphragm opening is to be enlarged via a line 55 by means of the applied oil pressure, while on the other side an electromagnet 56, working against this oil pressure, at the same time tends to reduce the diaphragm opening. A line of action 57 indicates that the electromagnet 56 is actuated in a specific manner by an electronic regulating arrangement 58. Also acting in accordance with the first proportional pressure valve 29 is the second proportional pressure valve 34, in which the oil pressure acts in the opening direction via a line 59 and an electromagnet 60 acts in the closing direction. A line of action 61 indicates that the electromagnet 60 is likewise actuated in a specific manner by the electronic regulating arrangement 58. In addition, the electronic regulating arrangement 58, as indicated by a line of action 62, is operatively connected to the displacement-measuring device 11. A line of action 63 indicates that commands and signals from a higher-level system control technology are also fed into the electronic regulating arrangement 58 and converted in it.

The two proportional pressure valves 29 and 34 are designed as seat valves, so that any decomposing or gumming of the oil cannot impair the function of these valves. A comparatively high reliability and availability of these valves is obtained by the seat type of construction. However, it is also possible to use servo valves at these locations of the arrangement.

Figure 2:
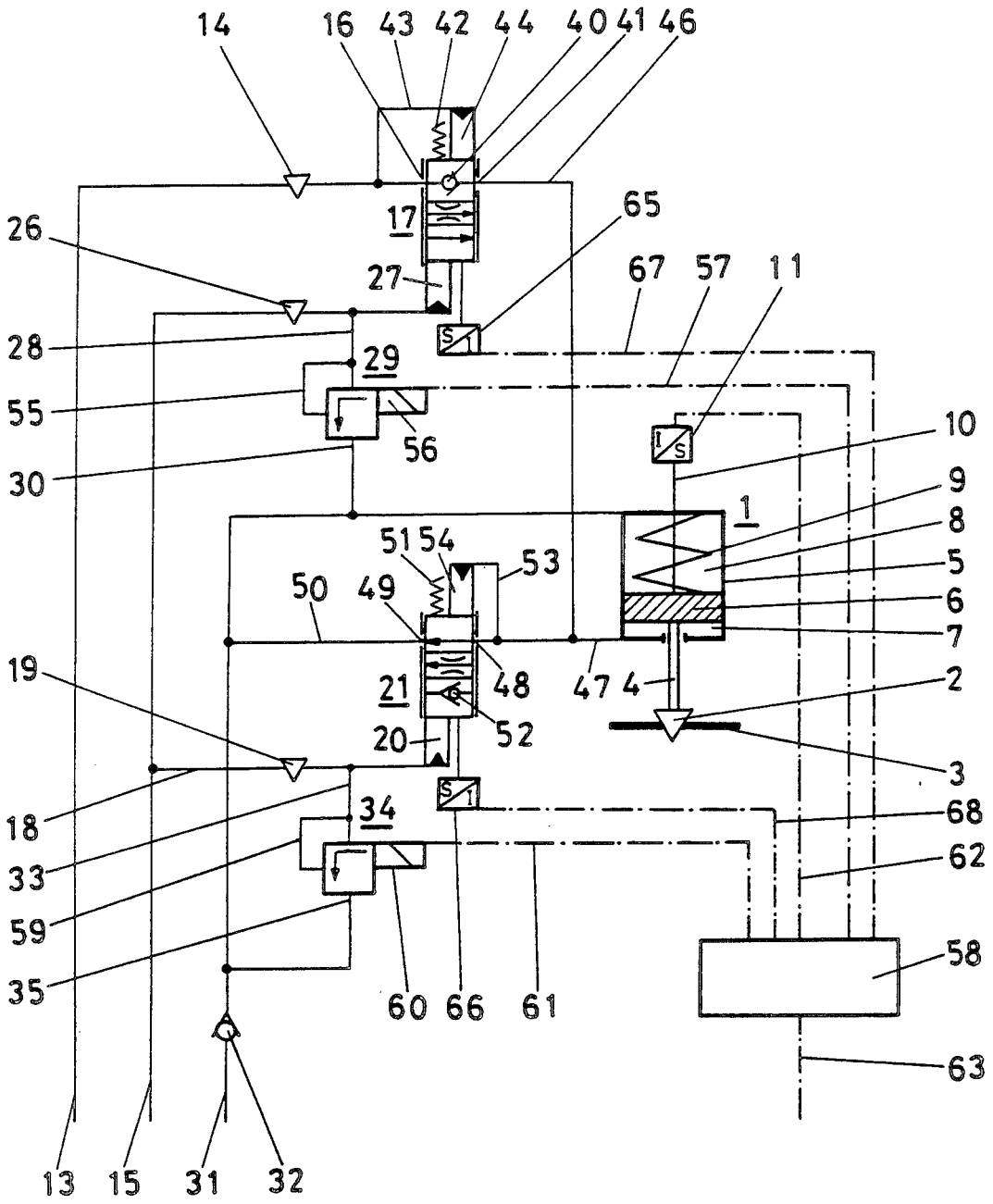
FIG. 2 shows a second embodiment of the drive.

The embodiment according to FIG. 2 corresponds virtually completely to the embodiment shown in FIG. 1, except that the control valves 17 and 21 are each additionally provided with a displacement-measuring device 65 and 66 respectively. As indicated by a line of action 67, the signals emitted by the displacement-measuring device 65 are fed into the electronic regulating arrangement 58 and further converted there. As indicated by a line of action 68, the signals emitted by the displacement-measuring device 66 are fed into the electronic regulating arrangement 58 and further processed there.

Figure 3:
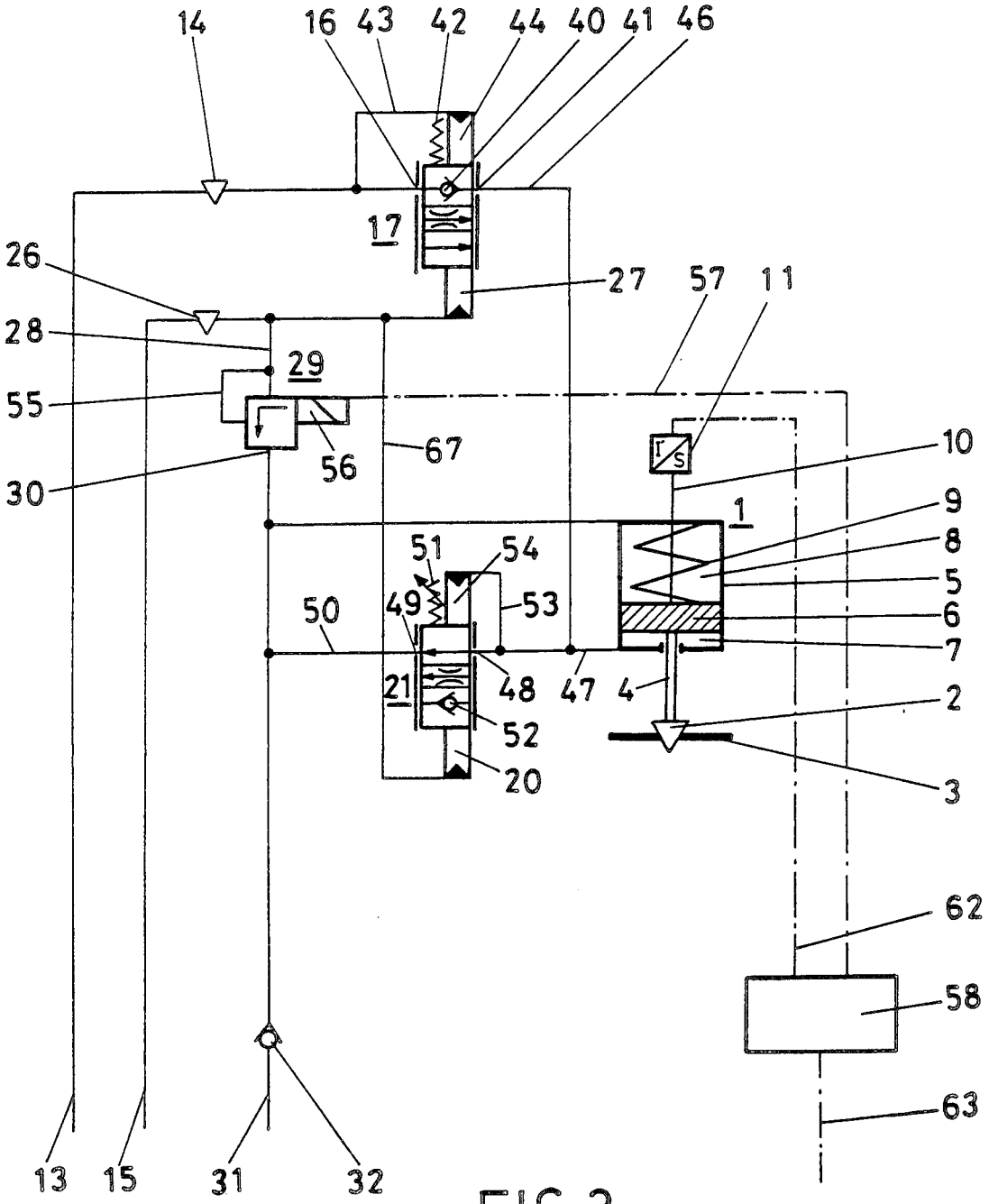
FIG. 3 shows a third embodiment of the drive.

Compared with the embodiment according to FIG. 1, the embodiment according to FIG. 3 merely has a single proportional pressure valve 29, which is acted upon by oil under pressure via the line 15 and the diaphragm 26. As already described, the drive volume 27 of the control valve 17 is acted upon by oil under pressure. In addition, however, a line 67 branches off from the line 15 between the diaphragm 26 and the drive volume 27. This line 67 leads directly into the drive volume 20 of the control valve 21. The drive volumes 27 and 20 are therefore acted upon in parallel and simultaneously by the oil under pressure fed in from the line 15. The springs 42 and 51, counteracting this oil under pressure, of the two control valves 17 and 21 are attached in such a way that their preloading force can be mechanically adjusted; this adjustability is symbolized by arrows.

FIG. 1 may be considered in more detail in order to explain the mode of operation. FIG. 1 shows the drive in the fail-safe position, in which, for example, the line 15 is not pressurized and in which the steam servo valve 2 is closed. However, it is also possible for both the line 13 and the line 15 to be pressurized and for the steam servo valve 2 to be closed solely by electrically deactivating the proportional pressure valves 29 and 34. In this case, the electromagnets 56 and 60 are deactivated in such a way that the oil pressure applied through the lines 55 and 59 sets the proportional pressure valves 29 and 34 to passage, so that no oil pressure can build up in the drive volumes 20 and 27. The result of this is that the control valves 17 and 21 are not actuated, so that their position shown in FIG. 1 is maintained and the steam servo valve 2 remains closed.

If the steam servo valve 2 is now to be opened, the electromagnets 56 and 60 are excited in a specific manner from the electronic regulating arrangement 58, so that the flow of oil through the proportional pressure valves 29 and 34 is reduced. An oil pressure consequently builds up in the region of the lines 28 and 33 and thus also in the drive volumes 27 and 20 of the control valves 17 and 21. This oil pressure continues to rise as the flow of oil is increasingly reduced. As soon as this oil pressure is high enough to overcome the counterforces in the control valves 17 and 21, the latter move out of the fail-safe position. The control valve 17 moves from the blocking position into the passage position having a regulatable cross-section, and the control valve 21 moves from the passage position having a constant cross-section into that having a regulatable cross-section. Oil now flows through the lines 13 and 46 via the connection 47 into the drive volume 7 of the servo drive 1 and simultaneously through the control valve 21 and the line 31 into the drain. If more oil subsequently flows through the line 46 than can flow off through the control valve 21, a pressure builds up in the drive volume 7, which pressure moves the servo drive 1 and thus also the steam servo valve 2 in the opening direction. The displacement-measuring device 11 supplies displacement-dependent signals to the electronic regulating arrangement 58, where they are analysed and compared with a preset desired value. This desired value is preset by a higher-level system control technology. In accordance with the result of this desired/actual value comparison, the excitation of the electromagnets 56 and 60 is changed from the electronic regulating arrangement 58, as a result of which the position of the regulatable control valves 17 and 21 is also correspondingly changed. However, if an excessive oil quantity should flow into the drive volume 7, the diaphragm 14 comes into effect, which prevents a further increase in the oil quantity flowing. The diaphragm 14 limits the opening time of the servo drive 1, so that no mechanical defects can occur in the servo drive 1 on account of, for instance, masses moved and to be braked too rapidly. Furthermore, this limiting of the opening time has a positive effect on the operating behavior of the turbine, which is therefore not subjected to any sudden loads with superheated steam.

The main piston 6 is pushed up by the oil fed into the drive volume 7; at the same time, the oil located in the buffer volume 8 flows through the line 31 into the drain. The opening movement of the servo drive 1 proceeds comparatively slowly, but for safety reasons closing must be effected very rapidly. During the closing movement of the servo drive 1, the oil flows out of the drive volume 7 through the control valve 21, the line 50 and the upper part of the line 31 directly into the buffer volume 8. In this way it is possible to remove the oil from the drive volume 7 over the shortest route and thus very quickly, as a result of which advantageously high dynamics of the servo drive 1 are obtained in the closing direction.

The embodiment according to FIG. 2 permits an even more sensitive and quicker approach to the preset desired value, since the signals from the displacement-measuring devices 65, 66 are additionally processed in the electronic regulating arrangement 58, as a result of which the desired value for the drive position can be obtained more quickly and more accurately. The mode of operation of this arrangement is otherwise the same as in the arrangement according to FIG. 1.

The embodiment according to FIG. 3 likewise works in a similar manner to the embodiment according to FIG. 1. However, the pressure build-up in the drive volumes 27 and 20 is here achieved by means of only one proportional pressure valve 29, so that both drive volumes 27 and 20 are pressurized at the same time and in an identical manner. Any adjustments of the response behavior of the regulating valves 17 and 21 can here be made during the commissioning of the plant by means of the preloading force, adjustable in each case, of the springs 42 and 51, so that here, too, despite identical pressurizing, different response instants corresponding to the respective operating tasks of the control valves 17 and 21 can be set. At comparatively little cost, this simplified embodiment can cover a comparatively wide range of requirements in an economically justifiable manner.

However, the fact that this drive for a steam servo valve 2 is suitable for actuation by high oil pressures has a particularly advantageous effect, and in fact pressures up to the region of 200 bar and higher are possible. These high pressures do not have an adverse effect on the operating reliability or the availability of the drive, since seat valves, whose operating behavior is not impaired by any oil gumming, are provided at all sealing locations where these high pressures occur; in particular, these valves are the proportional pressure valves 29 and 34 and the seat valves 40 and 52 of the control valves 17 and 21. The gain in dynamics for this arrangement which is achieved by the high actuating pressure can therefore be utilized advantageously and to the full extent for improving the regulating behavior of the arrangement.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A drive for a steam servo valve, comprising:

a servo drive for actuating said servo valve; and control valve means for regulating the actuating pressure of said servo drive, including at least two regulatable control valves and at least one pilot regulating valve for pressurizing said at least two control valves, each of said at least two control valves having a passage position having a constant cross-section, a passage position having a regulatable cross-section, and at least one blocking position including a seat valve producing a sealing location when in the blocking position.

2. The drive as claimed in claim 1, wherein the passage position having a regulatable cross-section has the same regulating characteristic in each of the at least two control valves, and comprising means for having this regulating characteristic come into effect simultaneously or with a time lag in the at least two control valves.

3. The drive as claimed in claim 1, wherein the passage position having a regulatable cross-section has a different regulating characteristic in each of the at least two control valves.

4. The drive as claimed in claim 1, wherein the at least two control valves are in each case pressurized via at least one pilot regulating valve.

5. The drive as claimed in either of claims 1 or 4, wherein the at least one pilot regulating valve is actuated electrically in a specific manner from an electronic regulating arrangement as a function of a measured position of the servo drive and a preset desired value for this position.

6. The drive as claimed in claim 5, wherein a proportional pressure valve or a servo valve is provided as the at least one pilot regulating valve.

7. The drive as claimed in claim 6, wherein the proportional pressure valve is designated as a seat valve.

8. The drive as claimed in claim 5, wherein the at least two control valves are each provided with a displacement-measuring device, and wherein measuring signals emitted in each case from the one displacement-measuring device are fed into the electronic regulating arrangement for further processing.

* * * * *